US010350656B2

(12) United States Patent
Kehoe et al.

(10) Patent No.: US 10,350,656 B2
(45) Date of Patent: Jul. 16, 2019

(54) DRAIN CLEARING AIR GUN

(71) Applicant: MILWAUKEE ELECTRIC TOOL CORPORATION, Brookfield, WI (US)

(72) Inventors: Sean T. Kehoe, Waukesha, WI (US); Ryan J. Denissen, Sussex, WI (US); Michael C. Reed, Wauwatosa, WI (US); Vasil Zhmendak, Wauwatosa, WI (US); Samuel J. Krohlow, Milwaukee, WI (US); Jingyuan Liang, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 227 days.

(21) Appl. No.: 15/621,535

(22) Filed: Jun. 13, 2017

(65) Prior Publication Data

US 2018/0133763 A1 May 17, 2018

Related U.S. Application Data

(60) Provisional application No. 62/479,003, filed on Mar. 30, 2017, provisional application No. 62/421,003, filed on Nov. 11, 2016.

(51) Int. Cl.
*B08B 9/032* (2006.01)
*E03C 1/308* (2006.01)
(Continued)

(52) U.S. Cl.
CPC ..... *B08B 9/0328* (2013.01); *B05B 1/005* (2013.01); *B05B 12/008* (2013.01); *B05B 15/63* (2018.02);
(Continued)

(58) Field of Classification Search
CPC . B08B 9/0328; B08B 1/005; B08B 2209/032; E03C 1/308
See application file for complete search history.

(56) References Cited

U.S. PATENT DOCUMENTS 964,575 A 7/1910 Sommerville
1,495,303 A 5/1924 Heidelberg
(Continued)

FOREIGN PATENT DOCUMENTS

CN 2236129 9/1996
CN 2699271 5/2005
(Continued)

OTHER PUBLICATIONS

International Search Report and Written Opinion for Application No. PCT/US2017/060524 dated Feb. 13, 2018, 17 pages.

*Primary Examiner* — Dung Van Nguyen
(74) *Attorney, Agent, or Firm* — Michaael Best & Friedrich LLP

(57) ABSTRACT

A drain clearing air gun includes a housing defining a main body, a handle positioned on a first end of the main body, and a nose positioned on a second end of the main body. A tank is at least partially positioned within the housing and includes a chamber for receiving pressurized air, where the tank has a first portion and a second portion that are coupled together to form the chamber. The first portion is disposed within the nose of the housing and is formed of a first material. The second portion is disposed within the main body of the housing and is formed of a second material that is different than the first material.

22 Claims, 13 Drawing Sheets

(51) Int. Cl.

| | |
|---|---|
| ***B05B 1/00*** | (2006.01) |
| ***B05B 12/00*** | (2018.01) |
| ***B05B 15/63*** | (2018.01) |
| *B08B 5/02* | (2006.01) |

(52) U.S. Cl.
CPC ..... *E03C 1/308* (2013.01); *B08B 5/02* (2013.01); *B08B 2209/032* (2013.01)

(56) References Cited

U.S. PATENT DOCUMENTS

| | | | | |
|---|---|---|---|---|
| 1,977,319 | A | | 10/1934 | McEwan |
| 1,998,902 | A | | 4/1935 | Mattich |
| 2,052,563 | A | | 9/1936 | Gould |
| 2,059,785 | A | | 11/1936 | Gaik |
| 2,187,043 | A | | 1/1940 | MacMillan |
| 2,267,064 | A | | 12/1941 | Wikelund |
| 2,386,870 | A | | 10/1945 | Lawton |
| 2,456,092 | A | | 12/1948 | Storevik |
| 2,638,126 | A | | 5/1953 | Hord |
| 2,697,842 | A | | 12/1954 | Meyer |
| 2,783,092 | A | * | 2/1957 | Gavin ..... A47L 9/08 15/405 |
| 3,426,774 | A | | 2/1969 | Conn |
| 3,743,186 | A | * | 7/1973 | Mocarski ..... B05B 1/005 239/413 |
| 3,880,355 | A | * | 4/1975 | Larson ..... B05B 1/005 239/288.3 |
| 3,934,280 | A | | 1/1976 | Tancredi |
| 4,053,955 | A | | 10/1977 | Canham |
| 4,063,317 | A | | 12/1977 | Santore |
| 4,445,236 | A | | 5/1984 | Nadolny et al. |
| 4,542,543 | A | | 9/1985 | Irwin |
| 4,614,479 | A | | 9/1986 | Liu |
| 4,629,128 | A | * | 12/1986 | Lawrence ..... B05B 1/005 134/166 R |
| 5,156,538 | A | | 10/1992 | Lee |
| 5,239,708 | A | | 8/1993 | Irwin |
| 5,249,311 | A | | 10/1993 | Rau |
| 5,416,947 | A | | 5/1995 | Jaffe |
| 5,522,094 | A | | 6/1996 | Balazs |
| 5,530,988 | A | | 7/1996 | McQuillan |
| 5,796,008 | A | | 8/1998 | Stoll et al. |
| 5,803,101 | A | | 9/1998 | Gallo |
| 5,803,847 | A | | 9/1998 | Kamm |
| 5,862,534 | A | | 1/1999 | Clay |
| 5,927,957 | A | | 7/1999 | Kennedy et al. |
| 5,940,897 | A | | 8/1999 | James |
| 6,032,301 | A | | 3/2000 | Wang |
| 6,035,455 | A | | 3/2000 | Rankovic |
| 6,070,487 | A | | 6/2000 | Beugelsdyk |
| 6,113,005 | A | | 9/2000 | Chih |
| 6,393,625 | B1 | | 5/2002 | Tsai |
| 6,892,401 | B1 | | 5/2005 | Mangum |
| 7,073,211 | B1 | | 7/2006 | Wu |
| 7,213,273 | B2 | | 5/2007 | Wang |
| 7,698,881 | B2 | | 4/2010 | McCane et al. |
| 7,850,555 | B2 | | 12/2010 | Keane |
| 7,874,807 | B2 | | 1/2011 | Hill et al. |
| 7,877,821 | B1 | | 2/2011 | Prestia |
| 8,393,873 | B2 | | 3/2013 | Hill et al. |
| 8,628,210 | B2 | | 1/2014 | Tucker et al. |
| 8,961,145 | B2 | | 2/2015 | Hill et al. |
| 9,309,990 | B2 | | 4/2016 | Chen |
| 2004/0010842 | A1 | | 1/2004 | Walsh |
| 2004/0034908 | A1 | | 2/2004 | Leaphart |
| 2005/0183709 | A1 | | 8/2005 | Marsac |
| 2005/0217011 | A1 | | 10/2005 | Smith |
| 2006/0096060 | A1 | * | 5/2006 | Zhang ..... B08B 9/055 15/406 |
| 2007/0266485 | A1 | | 11/2007 | Tackett |
| 2008/0216491 | A1 | | 9/2008 | Quest |
| 2009/0100582 | A1 | | 4/2009 | Williams |
| 2009/0191992 | A1 | | 7/2009 | Osborne |
| 2009/0223501 | A1 | | 9/2009 | Yeh |
| 2010/0058519 | A1 | | 3/2010 | Davenport |
| 2011/0000176 | A1 | | 1/2011 | Lahey et al. |
| 2011/0016658 | A1 | * | 1/2011 | Xia ..... E03C 1/304 15/344 |
| 2011/0056007 | A1 | | 3/2011 | Caywood |
| 2012/0247519 | A1 | | 10/2012 | Dondurur et al. |
| 2015/0074889 | A1 | | 3/2015 | Donohue et al. |
| 2016/0045924 | A1 | * | 2/2016 | Lin ..... B05B 7/0037 239/407 |
| 2016/0089683 | A1 | * | 3/2016 | Hu ..... B05B 9/01 15/345 |

FOREIGN PATENT DOCUMENTS

| | | |
|---|---|---|
| CN | 200989840 | 12/2007 |
| CN | 201016831 | 2/2008 |
| CN | 201269097 | 7/2009 |
| CN | 101532898 | 9/2009 |
| CN | 202273840 | 6/2012 |
| CN | 202329924 | 7/2012 |
| CN | 202661222 | 1/2013 |
| CN | 203132767 | 8/2013 |
| CN | 203191148 | 9/2013 |
| EP | 1710360 | 12/2007 |
| EP | 1798353 | 11/2008 |
| EP | 2278080 | 1/2011 |
| EP | 2848907 | 3/2015 |
| WO | 2004035230 | 4/2004 |
| WO | WO2005/059360 | 6/2005 |
| WO | WO2010/002298 | 1/2010 |

* cited by examiner

DRAIN CLEARING AIR GUN

CROSS-REFERENCE TO RELATED APPLICATIONS

This application claims priority to U.S. Provisional Application No. 62/421,003, filed Nov. 11, 2016, and to U.S. Provisional Application No. 62/479,003, filed Mar. 30, 2017, the entire contents of both of which are incorporated by reference herein.

BACKGROUND

The present invention relates to drain clearing tools, and particularly, to drain clearers that use pressurized air, gas, or water to unclog a drain.

Drain clearing guns, or kinetic water rams, are used to unclog drains and other conduits. Drain clearing guns are typically hand-pump powered machines. A pump is driven by hand to build up pressure in a storage tank. A conduit or nozzle is directed into a drain, and then the pressurized air is released down the conduit to attempt to free a clog. Other drain clearing guns use a pressurized gas cartridge rather than a pump to create pressurized air. These cartridges must be replaced with a new cartridge after each use.

SUMMARY

In one embodiment, the invention provides a drain clearing air gun including a housing defining a main body, a handle positioned on a first end of the main body, and a nose positioned on a second end of the main body. A tank is at least partially positioned within the housing and includes a chamber for receiving pressurized air, where the tank has a first portion and a second portion that are coupled together to form the chamber. The first portion is disposed within the nose of the housing and is formed of a first material. The second portion is disposed within the main body of the housing and is formed of a second material that is different than the first material.

In another embodiment, the invention provides a drain clearing air gun including a housing defining a main body, a handle positioned on a first end of the main body, and a nose positioned on a second end of the main body. A tank is at least partially positioned within the housing and includes a chamber for receiving pressurized air. The tank includes an outer wall defining a boundary of the tank, where the boundary has a maximum length and a maximum height. The tank also includes a recess formed within the tank such that a section of the outer wall that defines the recess is positioned within the maximum length and the maximum height of the boundary. A motor is positioned within the main body of the housing, and at least a portion of the motor is received within the recess of the tank such that the motor overlaps with the boundary of the tank. A pump is positioned within the main body of the housing and is operatively coupled to the motor, where the pump is driven by the motor to pump air into the tank.

In yet another embodiment, the invention provides a drain clearing air gun including a housing defining a main body, a handle positioned on a first end of the main body, and a nose positioned on a second end of the main body. A tank is at least partially positioned within the housing and includes a chamber for receiving pressurized air. The tank has a nose end with an opening disposed within the nose of the housing and a rear end disposed within the main body of the housing. A pilot valve is disposed within the tank proximate the rear end of the tank, and the pilot valve is operable to selectively release pressurized air from the chamber of the tank. A conduit is disposed within the tank, where the conduit extends from the pilot valve to the opening of the tank to direct pressurized air out of the tank through the opening.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Drain clearing guns can use pressurized air or other pressurized fluids to clear drains. A drain clearing gun includes a pump driven to build up pressure in a storage tank. The drain clearing gun also includes a plunger that is directed onto a drain, and the pressurized air is released from the storage tank through the plunger down the drain to attempt to free a clog. In some embodiments, the drain clearing gun may be battery operated so that battery-powered build-up of fluid pressure can be released onto the clogged drain or pipe.

Figure 1:
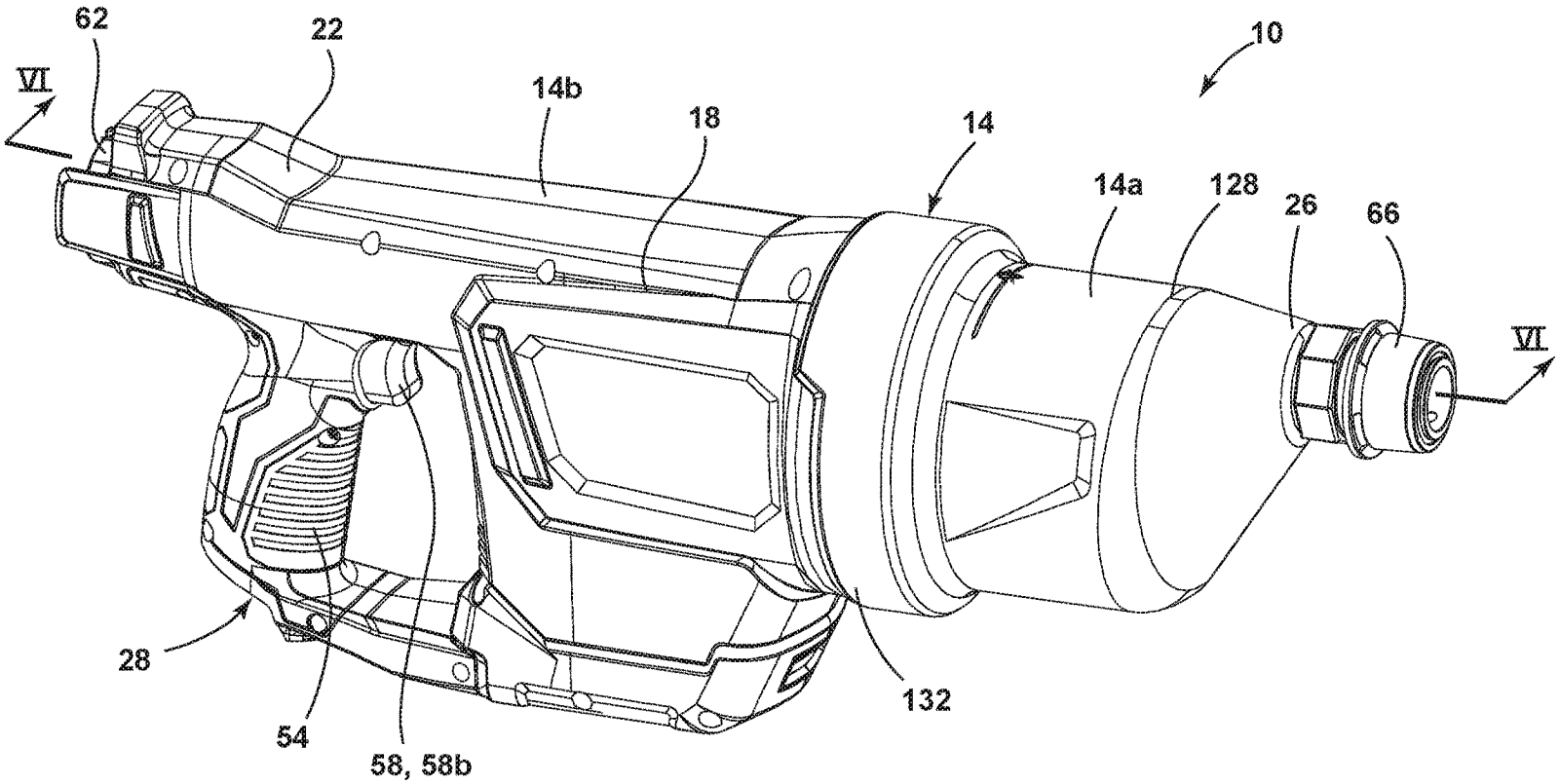
FIG. 1 is a perspective view of a drain clearing air gun according to one embodiment of the invention.
Figure 2:
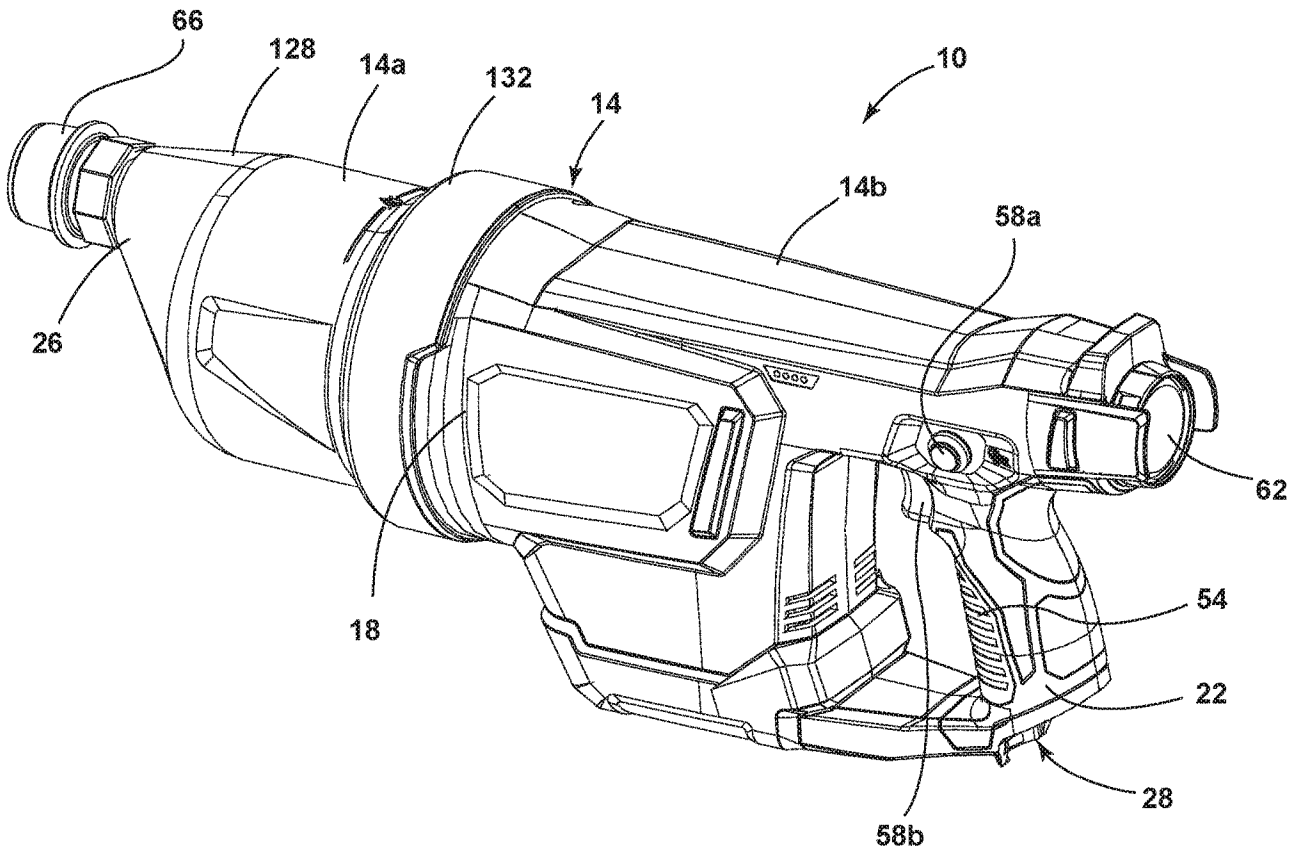
FIG. 2 is another perspective view of the drain clearing air gun of FIG. 1.
Figure 3:
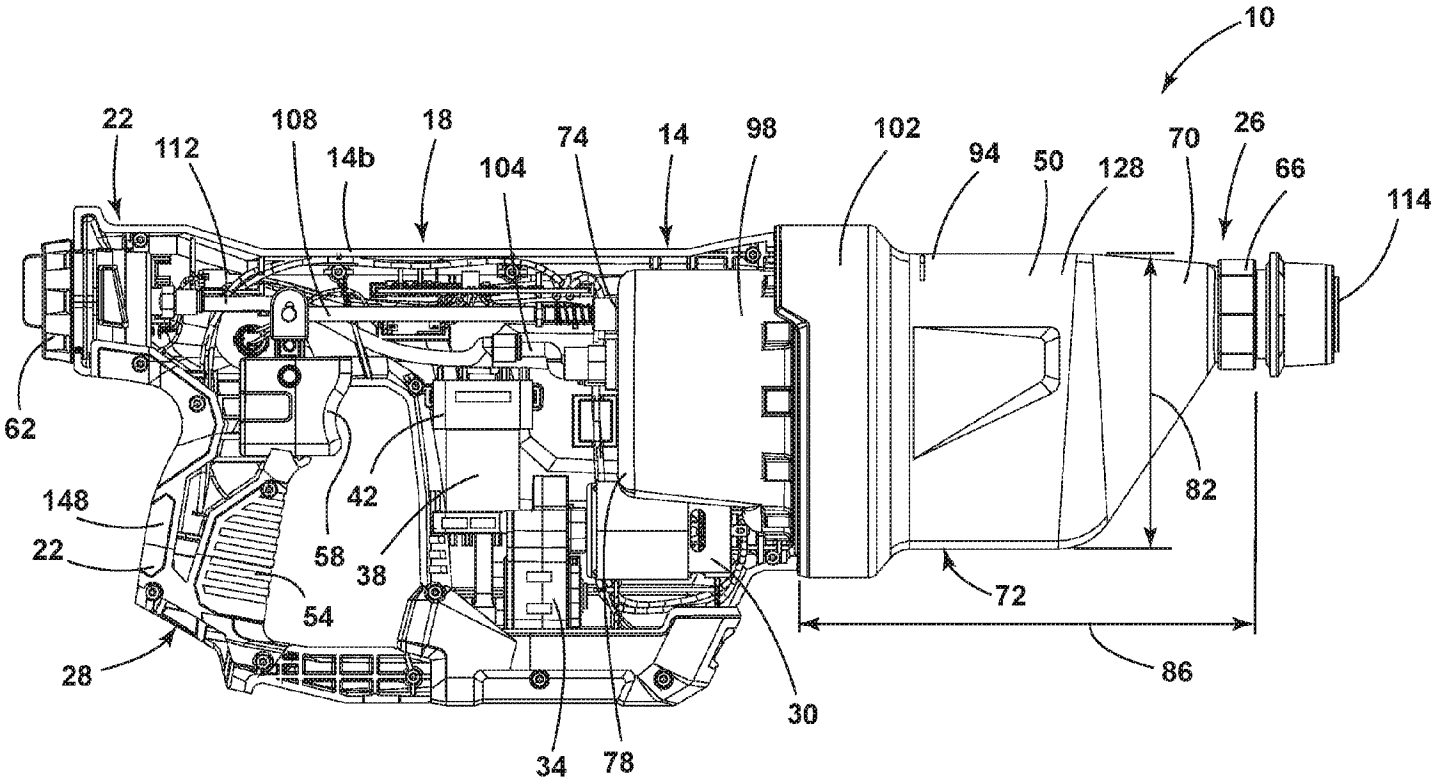
FIG. 3 is a side view of the drain clearing air gun of FIG. 1 with a portion of the housing removed to reveal the internal components of the drain clearing air gun.

FIGS. 1-3 illustrate a drain clearing air gun 10. The drain clearing air gun 10 includes a housing 14 defining a main body 18, a handle 22, and a nose 26. The handle 22 is positioned on a first end of the main body 18, and the nose 26 is positioned on a second end of the main body 18 opposite the first end. The housing 14 includes a front housing 14*a* surrounding the nose 26 and a rear housing 14*b* surrounding the main body 18 and the handle 22. The main body 18 houses a motor 30, a drive assembly 34, a compressor 38, and a pump 42 (together "the air pressure assembly"). In addition, the main body 18 houses a pilot valve 46 and at least a portion of a tank 50. In the illustrated embodiment, the tank 50 extends into the nose 26 and is partially surrounded by the front housing 14*a* as well as the rear housing 14*b*. The handle 22 includes a grip 54 supporting one or more actuators 58. In the illustrated embodiment, the handle 22 has two actuators 58: a first actuator 58*a* to start the build up of pressurized air inside the tank 50, and a second actuator 58*b* to release the pressurized air into the drain. In the illustrated embodiment, the first actuator 58*a* is a button, and the second actuator 58*b* is a trigger. In other embodiments, different actuators 58 can be used. In addition, the handle 22 also supports a pressure gauge 62 to help control the pressure in the tank 50.

In the illustrated embodiment, the drain clearing air gun 10 is powered by a battery pack, which is received within a battery receptacle 28 below the handle 22. The battery pack is electrically coupled to the motor 30 through the actuator 58*a* to selectively energize the motor 30. In some embodiments, the battery pack may be a power tool battery pack, such as a Li-ion battery pack. In other embodiments, the drain clearing air gun 10 may be powered by AC power through a power cord. During operation, the nose 26 is inserted into the drain to be cleaned to direct pressurized air down the drain conduit. The nose 26 includes a connection mechanism 66 configured to releasably couple different accessories 68 (FIG. 11) on the nose 26 of the drain clearing air gun 10.

Referring to FIG. 3, the illustrated drain clearing air gun 10 generally operates as follows. As user actuates the first actuator 58*a* to energize the motor 30. The motor 30 drives the drive assembly 34, which drives the compressor 38 and the pump 42 to pump air into the tank 50. As the tank 50 fills with air, the pressure within the tank 50 will continue to rise. The pressure gauge 62 helps identify the pressure in the tank 50 to obtain the desired air pressure. Once the desired air pressure is reached, the user actuates the second actuator 58*b* to open the pilot valve 46 and release the pressurized air from the tank 50 into the drain.

As will be explained in detail below, the components of the illustrated drain clearing air gun 10 are arranged in a configuration that provides certain advantages. For example, the illustrated arrangement allows for a compact design. In addition, the arrangement limits the contact of the electrical components and the moving components of the drain clearing air gun 10 with water.

Tank/Motor Layout

With reference to FIGS. 3-6, the tank 50, the motor 30, and the pilot valve 46 are arranged to provide a compact configuration. The motor 30 and the pilot valve 46 are recessed within the tank 50. Specifically, the motor 30 and the pilot valve 46 overlap with a boundary of the tank 50 to minimize the overall length and height of the drain clearing air gun 10. This allows the drain clearing air gun 10 to fit into tighter spaces during operation.

Figure 4:
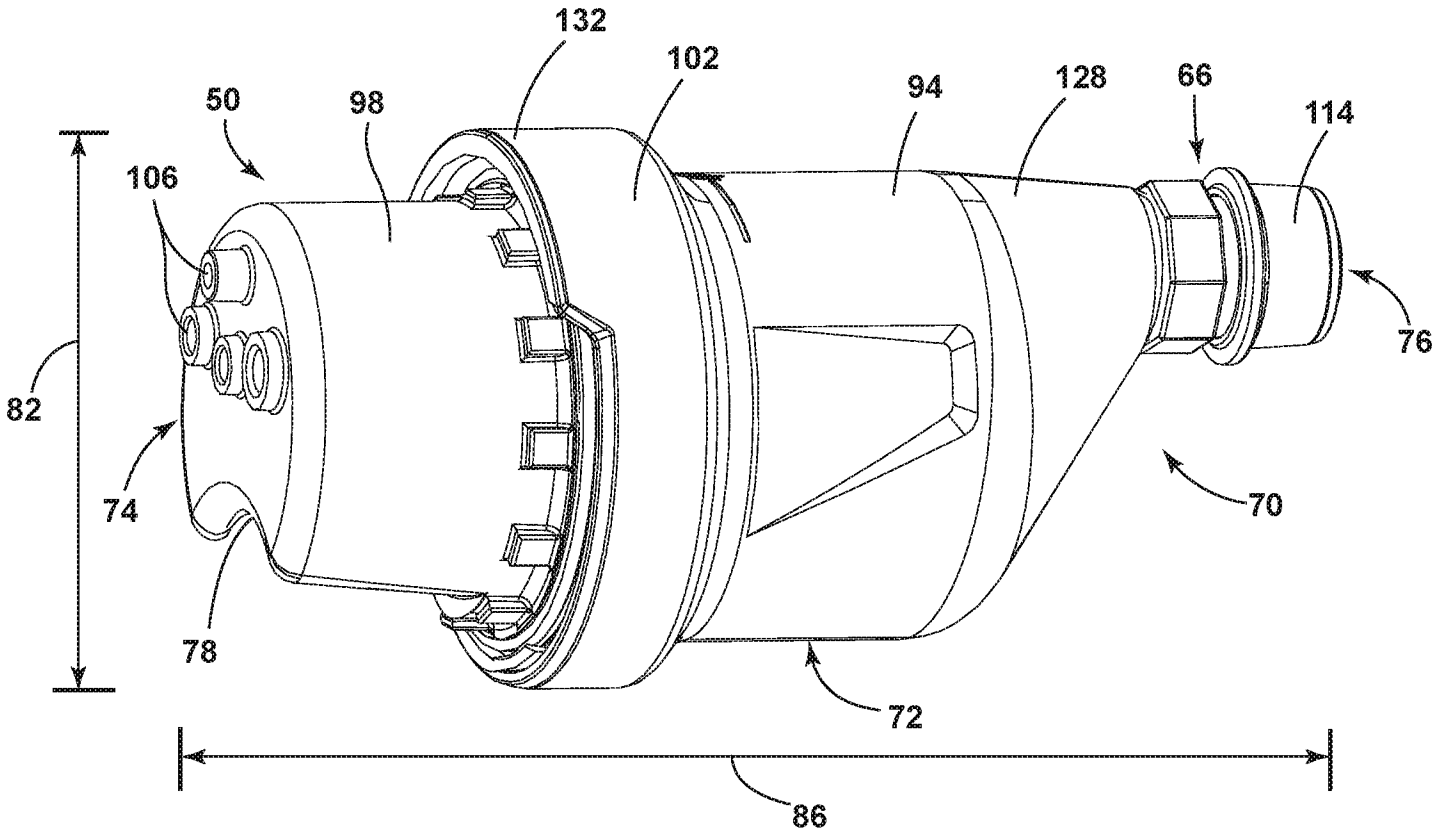
FIG. 4 is a perspective view of a tank of the drain clearing air gun of FIG. 1.
Figure 5:
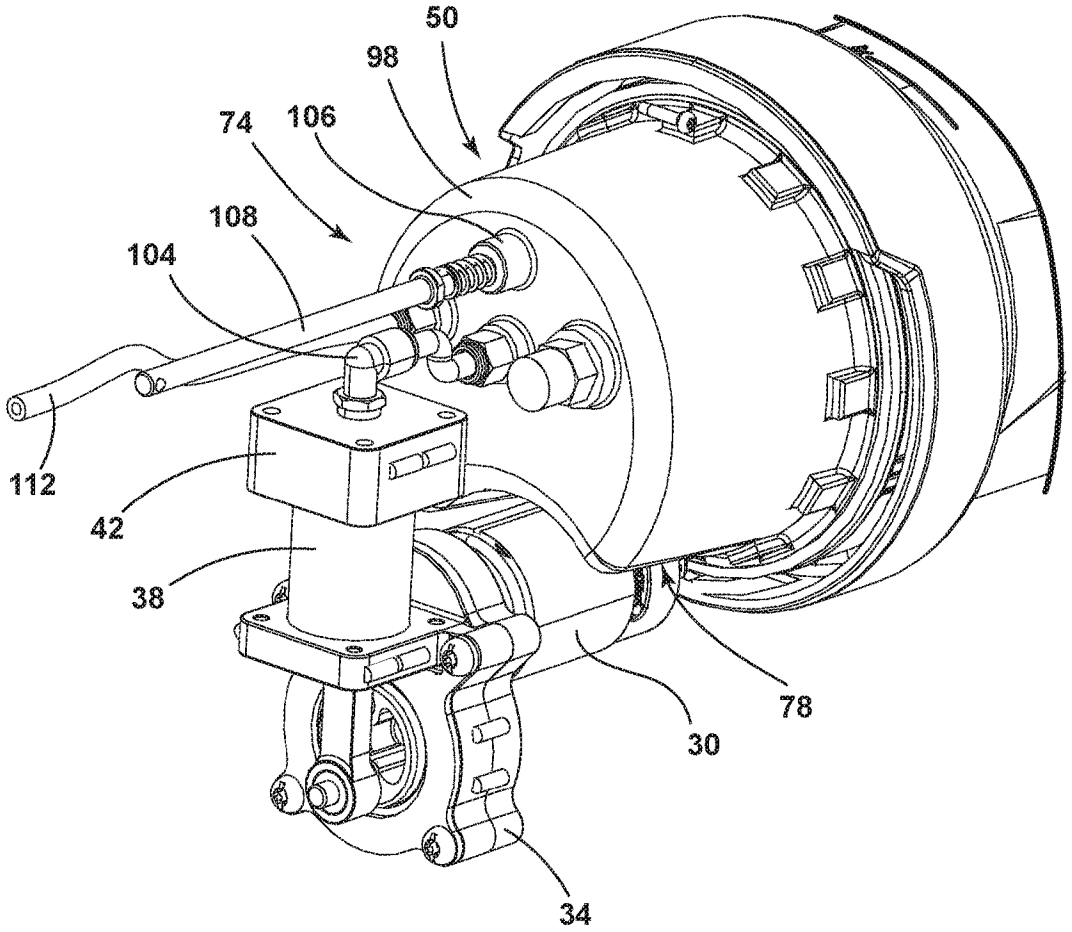
FIG. 5 is a rear perspective view of a motor, a drive assembly, a pump, and the tank of the drain clearing air gun of FIG. 1.

As shown in FIGS. 4 and 5, the tank 50 is generally cylindrical with an outer wall 72 defining a boundary of the tank 50 and a recess 78 for receiving the motor 30. The tank 50 includes a nose end 70 directed towards the nose 26 of the drain clearing air gun 10 and a rear end 74 directed towards the handle 22 of the drain clearing air gun 10. The nose end 70 is sloped such that the nose end 70 becomes narrower where pressurized air is discharged from the tank 50. The nose end 70 includes an opening 76 (FIG. 6) disposed within the nose 26 of the housing 14. Pressurized air, which is built up in the tank 50, is released through the opening 76 of the tank 50.

The rear end 74 of the tank 50 includes a recess 78 for receiving the motor 30. Accordingly, the motor 30 overlaps with boundary of the tank 50. Specifically, the tank 50 includes a maximum overall height 82 and a maximum overall length 86. The recess 78 is set within the tank 50 such that a section of the outer wall 72 that defines the recess 78 is within either the maximum overall height 82 of the tank 50, the maximum overall length 86 of the tank 50, or both. In the illustrated embodiment, the motor 30 overlaps with the boundary of the tank 50 in both the lengthwise direction and the height direction. In other embodiments, the motor 30 may only overlap the boundary of the tank 50 in one direction. In the illustrated embodiment, the recess 78 is concave to accommodate the cylindrical shape of the motor 30. However, in other embodiments, the recess 78 can be sizes and shapes to accommodate different sizes and shapes of the motor 30.

Figure 6:
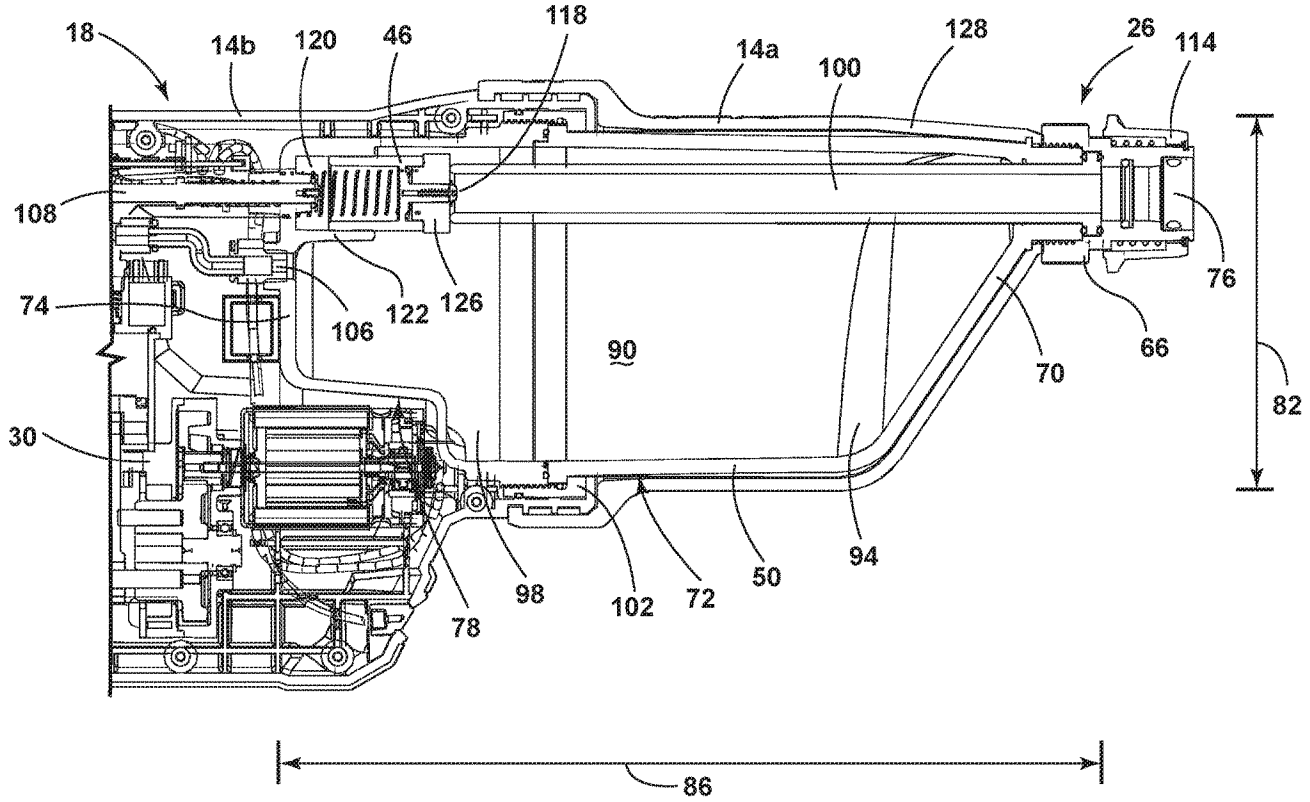
FIG. 6 is a cross-sectional view of a portion of the drain clearing air gun taken along section line 6-6 of FIG. 1, including the motor, the tank, a pilot valve, and a connection mechanism.

As shown in FIG. 6, the pilot valve 46 is positioned within the tank 50. The tank 50 includes a compartment 52 for receiving the pilot valve 46 and supporting the pilot valve 46 within a chamber 90 of the tank 50. The compartment 52 is formed in the rear end 74 of the tank 50. In the illustrated embodiment, the pilot valve 46 is positioned entirely inside the tank 50. In other embodiments, a portion of the pilot valve 46 extends beyond the boundary of the tank 50.

Bi-Material Tank

With reference to FIGS. 4-6, the tank 50 includes a first portion 94 and a second portion 98 that are fitted together to form the chamber 90. In the illustrated embodiment, the first portion 94 and the second portion 98 are joined together by a threaded collar 102. The first portion 94 defines the nose end 70 of the tank 50 and is disposed within the nose 26 of the housing 14. The second portion 98 defines the rear end 74 of the tank 50 and is disposed within the main body 18 of the housing 14. The second portion 98 of the tank 50 includes the compartment 52 for supporting the pilot valve 46 and the recess 78 for receiving the motor 30. In addition, the second portion 98 includes a plurality of openings 106 for connecting the tank 50 to various working components of the drain clearing air gun 10. For example, the plurality of openings 106 provides connections to the pump 42, the pilot valve 46, and the pressure gauge 62. More particularly, one of the openings 106 couples to a conduit 104 for fluidly connecting the pump 42 to the chamber 90, another opening 106 receives a rod 108 that couples the pilot valve 46 to the second actuator 58*b*, and another opening 106 couples to a conduit 112 for fluidly connecting the pressure gauge 62 to the chamber 90. The first portion 94 extends into the nose 26 and connects to the connection mechanism 66. The first portion 94 has a more simple and smooth geometry than the second portion 98, while the second portion 98 is more robust and precisely machined to support and interface with the other components of the drain clearing air gun 10.

In the illustrated embodiment, the first portion 94 and the second portion 98 of the tank 50 are made of two different materials. The first portion 94 is formed of a first material that is light weight. On the other hand, the second portion 98 is formed of a second material that is stronger and can be more easily formed into complex shapes. For example, the first portion 94 may be formed of a plastic, such as polyurethane or a thermos-type plastic, while the second portion 98 may be formed of a metal, such as aluminum or stainless steel. The second portion 98 of the tank 50 has a somewhat complicated topology to accommodate the other components of the drain clearing air gun 10. For example, the second portion 98 includes the recess 78 for the motor 30, the compartment 52 for the pilot valve 46, and the openings 106 for connecting to other components. By forming the second portion 98 of the tank 50 from metal, better tolerances and more complicated matching geometries can be formed in the tank 50. Using a metal is useful because it can be difficult to mold plastic at the thicknesses required to accommodate this topology. On the first portion 94 of the tank 50, where the topology is less complicated, plastic can be used, as it is lighter. In addition, the first portion 94 can be made of a corrosion-resistant material (e.g., plastic), which is beneficial if the nose 26 of the drain clearing air gun 10 is submerged in water. The use of two materials provides a benefit of balancing weight and strength, and allows for easy assembly and manufacturing.

Air Release Assembly

Figure 7:
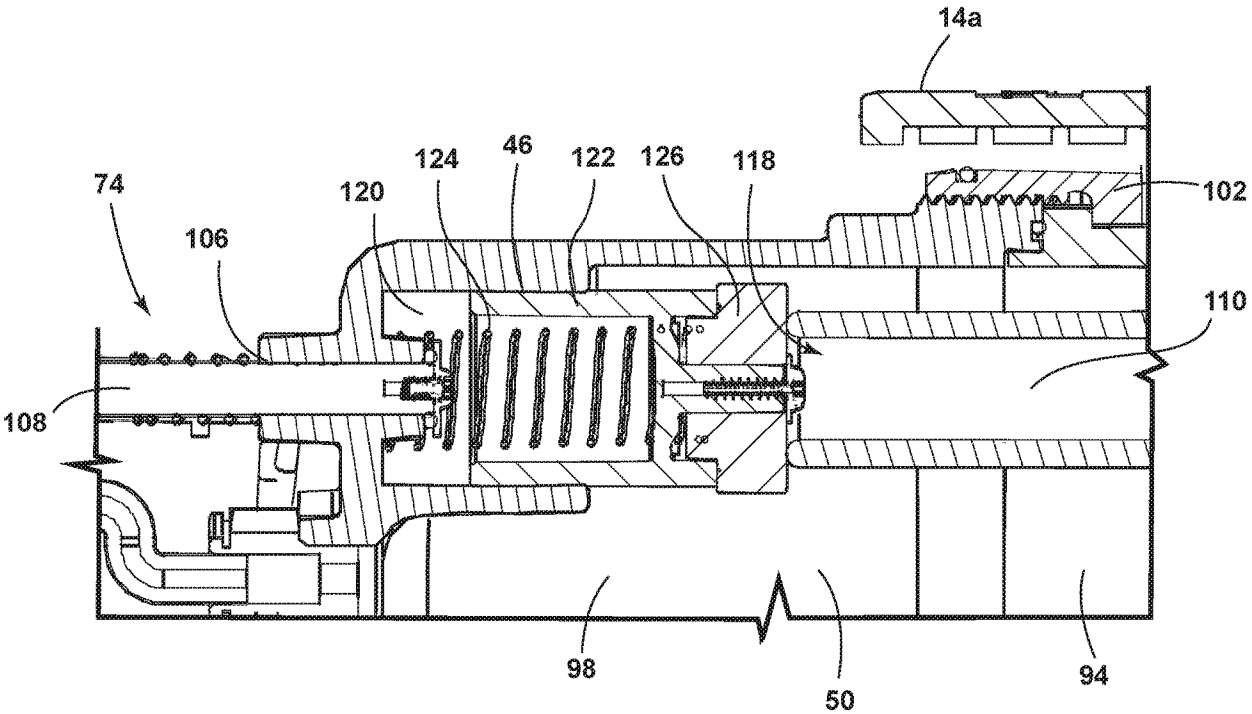
FIG. 7 is an enlarged cross-sectional view of the pilot valve shown in FIG. 6.

FIGS. 6 and 7 illustrate an air release assembly. The air release assembly includes the pilot valve 46, a conduit 110, and a nozzle 114. In the illustrated embodiment, the nozzle 114 is positioned at the nose end 70 of the tank 50 proximate a tip of the nose 26. The pilot valve 46 is positioned at the rear end 74 of the tank 50 within the main body 18. The rear end 74 is opposite the nose end 70 of the tank 50. The conduit 110 is disposed within the chamber 90 of the tank 50 and extends from the nozzle 114 to the pilot valve 46. In the illustrated embodiment, the conduit 110 is a straight pipe. In other embodiments, other suitable conduits may alternatively be used. In some embodiments, the conduit 110 may be integrally formed with the tank 50. Air pressurized within the tank 50 is expelled from the drain clearing air gun 10 and directed towards a clog through the nozzle 114. The conduit 110 receives pressurized air from the chamber 90 of the tank 50 and supplies the pressurized air to the nozzle 114. The pilot valve 46 controls the airflow from the chamber 90 of the tank 50 into the conduit 110.

During the pressure build up stage, the interior of the conduit 110 is sealed off from the chamber 90 of the tank 50 and, therefore, remains at ambient pressure. When the conduit 110 is no longer sealed off from the chamber 90 (e.g., when the pilot valve 46 is opened), pressurized air flows from the chamber 90 of the tank 50, into the conduit 110, and through the nozzle 114. The pilot valve 46 is used to open and close an inlet 118 of the conduit 110 and allow or inhibit air from flowing into the conduit 110. The pilot valve 46 includes a plunger 122 that slides within a bore 120 to selectively seal the inlet 118 of the conduit 110. In the illustrated embodiment, the plunger 122 includes a sealing member 126 to seal the inlet 118. The plunger 122 is movable within the bore 120 between a closed configuration, in which the inlet 118 of the conduit 110 is sealed by the sealing member 126, and an open configuration, in which the plunger 122 moves away from inlet 118 and the conduit 110 is opened. The illustrated pilot valve 46 also includes a spring 124 coupled to the plunger 122. The spring 124 biases the plunger 122 to the closed configuration (i.e., toward the conduit 110).

As the pump 42 pumps air into the chamber 90 of the tank 50, the plunger 122 moves into the closed configuration. Air flows into the chamber 90 surrounding the conduit 110 and builds up air pressure until a predetermined pressure is reached. Once the predetermined pressure is reached, the pump 42 discontinues pumping air. The plunger 122 remains in the closed configuration until the pilot valve 46 is opened by actuating the second actuator **58*b* on the handle 22 of the drain clearing air gun 10. In the illustrated embodiment, actuating the second actuator 58*b* pulls the rod 108 to move the plunger 122 against the bias of the spring 124. When the pilot valve 46 is opened, air is released from below the plunger 122, allowing the plunger 122 to move away from the inlet 118 of the conduit 110. The high pressure air surrounding the conduit 110 moves through the conduit 110 and out the nozzle 114** towards the clog.

Based on the function of the pilot valve 46, once the actuator **58*b* is actuated, the plunger 122 sealing the inlet 118 of the conduit 110 is pushed away from the conduit 110, causing the high pressure air to enter the conduit 110 and exit the drain clearing air gun 10. The high pressure air traveling from the chamber 90 to the conduit 110 maintains the plunger 122 in the open configuration until the pressure within the tank 50 reduces to closer to ambient pressure. This ensures that the air will be delivered in a single release and stops a user from "feathering" the actuator 58, which may be undesirable. Additionally, the second actuator 58*b* is mechanically coupled to pilot valve 46 (e.g., via the rod 108) such that the actuator 58*b* does not require any power from the drain clearing air gun 10 (e.g., from the battery pack) to operate and release the air pressure in the tank 50, which may be desirable if, for example, the battery pack runs out of power while the tank 50 is pressurized. The user simply needs to overcome the spring force (not the pressure force) to cause the pressurized air in the tank 50** to be released.

Submersible Front End

With reference to FIGS. 3 and 6, the nose 26 of the plunger 122 is fully submersible in water. The arrangement of the air release assembly as well as the air pressure assembly allows the working components of the drain clearing air gun 10 to have limited exposure to water. Specifically, the arrangement of the pilot valve 46, the pump 42, the compressor 38, and the motor 30 at the rear end 74 of the tank 50 enables the nose 26 of the drain clearing air gun 10 to be submerged in water while the working components remain up and out of the water. Additionally, there are no electronics or sensitive mechanisms in the nose 26 of the drain clearing air gun 10. There is a sealed electronics compartment to protect the water sensitive elements. This allows users to dunk the front end of the plunger 122 into water without any negative effects on the electronics or mechanism. This may provide improved valve functionality and life of the drain clearing air gun 10. In the illustrated embodiment, about 9 inches (229 mm) of a front of the nose 26 is submersible in water. In other embodiments, more or less of the front of the nose 26 may be submersible.

Figure 15:
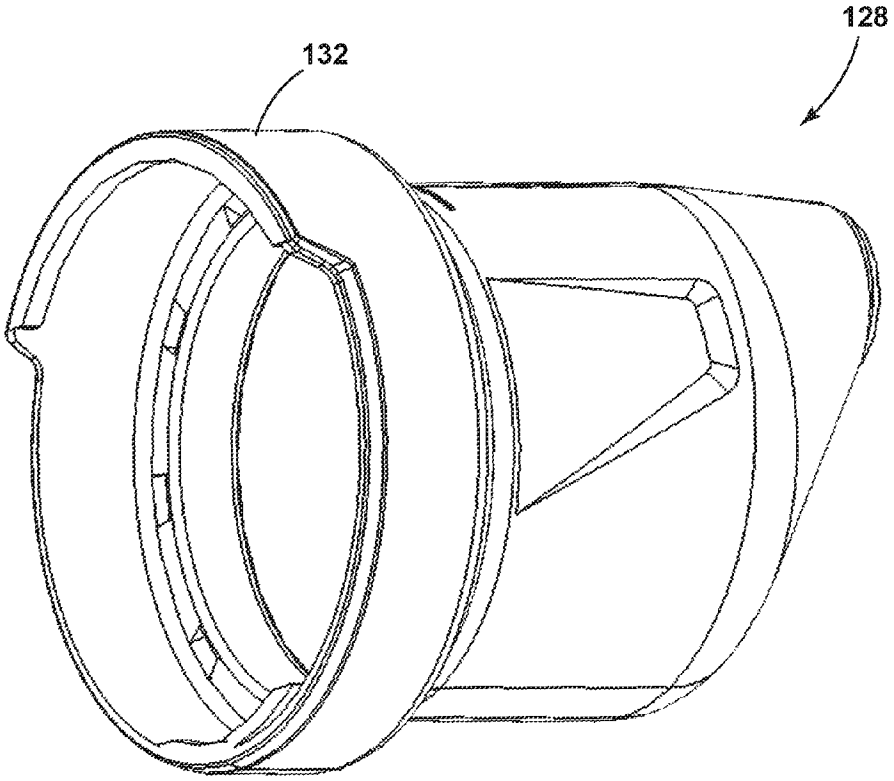
FIG. 15 illustrates a boot for use with the drain clearing air gun of FIG. 1.

In addition, with reference to FIGS. 1, 6, and 15, in some embodiments the drain clearing air gun 10 includes a boot 128 surrounding a portion of the tank 50. In the illustrated embodiment, the boot 128 surrounds the entire nose 26, however, in other embodiments the boot 128 can surround more or less of the drain clearing air gun 10. The boot 128 helps to further water proof the nose 26. In the illustrated embodiment, the boot 128 is composed of a rubber material that helps create an air tight seal around the nose 26. The boot 128 includes a lip that extends over a portion of the rear housing 14*b* to inhibit water from entering the drain clearing air gun 10 at the junction of the front housing 14*a* and the rear housing 14*b*. Furthermore, the handle 22 includes a seal 148 (FIG. 3) to further protect the drain clearing air gun 10 from ingress of water.

Automatic Shutoff and Noise Filtration

As previously mentioned, the pressure gauge 62 helps to identify and control the pressure in the tank 50. More specifically, the pressure gauge 62 includes an automatic shutoff feature that stops the motor 30 from over-pressurizing the tank 50. In the illustrated embodiment, the pressure gauge 62 provides a single needle shutoff design, a safety shutoff feature, and an electronic noise filtration for increased pressure accuracy.

Figure 9:
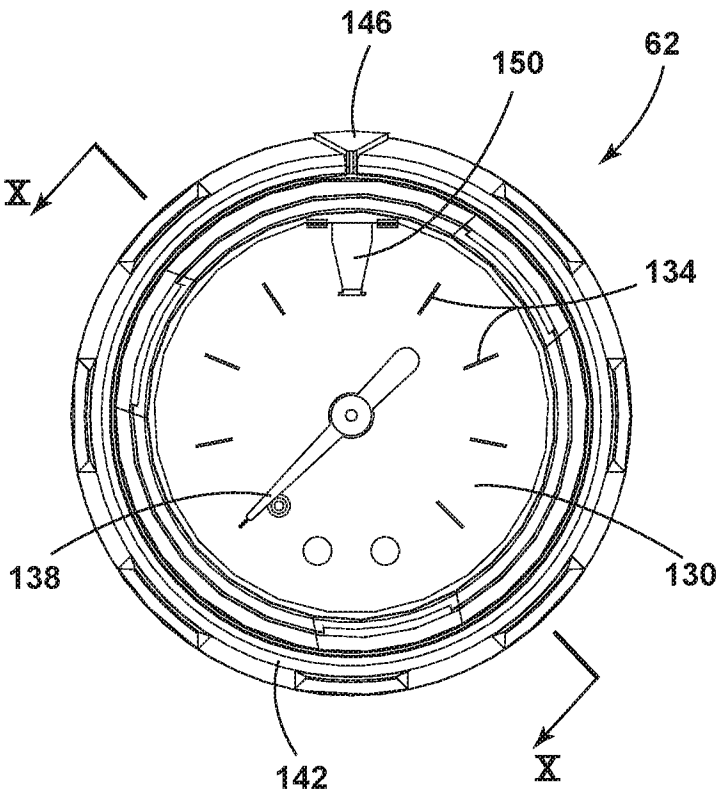
FIG. 9 a front view of the pressure gauge of FIG. 8.
Figure 8:
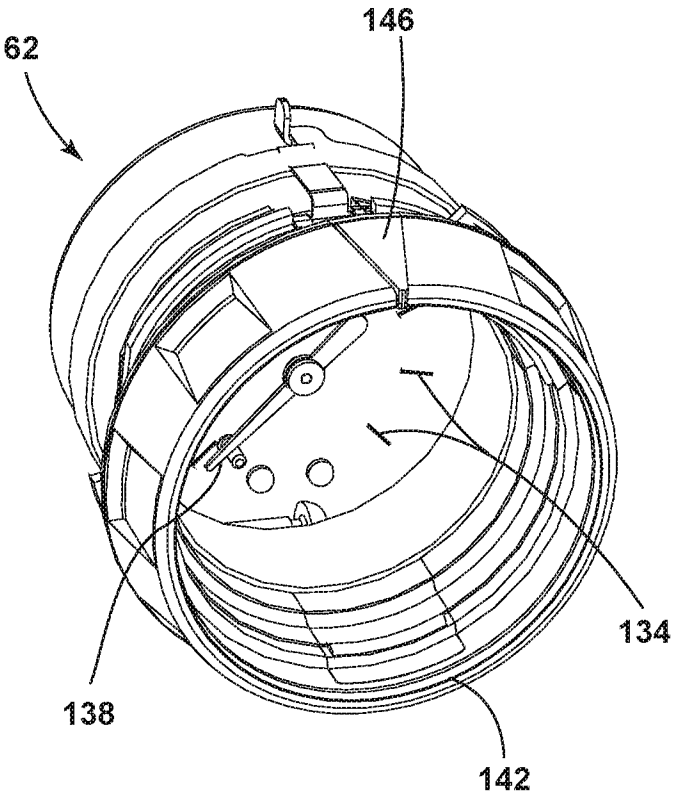
FIG. 8 is a perspective view of a pressure gauge for use with the drain clearing air gun of FIG. 1.
Figure 10:
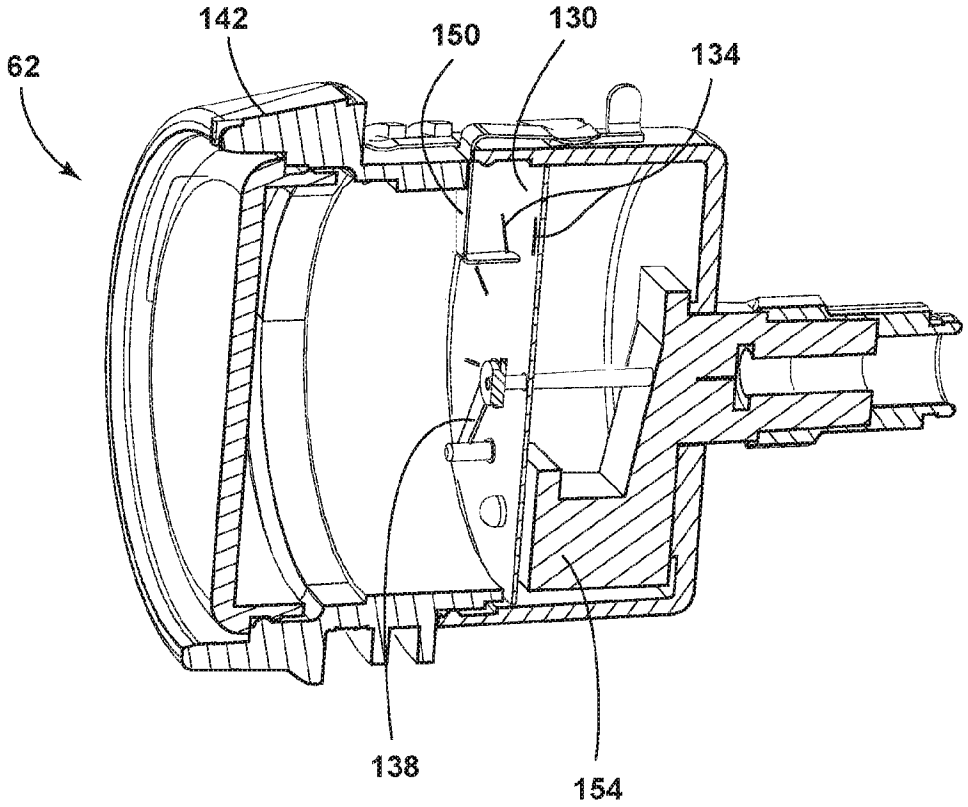
FIG. 10 a cross-sectional view of the pressure gauge of FIG. 8 taken along section line 10-10 in FIG. 9.

With respect to the single needle shutoff design, the pressure gauge 62 enables a user to set a desired maximum pressure, and the pressure gauge 62 will automatically shut off the air pressure system when the desired pressure is reached. Referring to FIGS. 8-10, the pressure gauge 62 includes a faceplate 130 with tick marks 134 representing various pressures. A needle 138 is rotatably coupled to the faceplate. The needle 138 rotates about the faceplate and aligns with different tick marks 134 to indicate the current pressure measured by the pressure gauge 62. In some embodiments, the pressure gauge 62 includes a bladder (not shown), for example, made of copper. When the pressure increases, the bladder is displaced, moving the needle 138 on the pressure gauge 62. In the illustrated embodiment, the needle 138 is composed of an electrically conductive material.

The illustrated pressure gauge 62 also includes a bezel 142 to indicate a pressure desired by a user. The bezel 142 concentrically surrounds the faceplate 130 and is rotatable relative to the faceplate 130. The bezel 142 includes an indicator 146 that can be aligned with the tick marks 134 to indicate a maximum desired pressure. Specifically, a user can rotate the bezel 142 until the indicator 146 indicates the desired maximum pressure. An electrical contact 150 is coupled to the inside of the bezel 142 and is aligned with the indicator 146. When the bezel 142 is rotated, the electrical contact 150 is rotated with the bezel 142 such that the electrical contact 150 maintains alignment with the indicator 146.

As the pressure gauge 62 measures pressure, the needle 138 continuously moves relative to the faceplate 130 to indicate the current measured pressure. For example, as the pressure of the tank 50 increases, the needle 138 will rotate (e.g., in a clockwise direction) to indicate the increasing pressure. When the needle 138 of the pressure gauge 62 reaches the desired maximum pressure (e.g., the location of the indicator 146), the needle 138 aligns with and engages the electrical contact 150, which is aligned with the indicator 146. In some embodiments, contact between the needle 138 and the electrical contact 150 completes an electrical circuit, triggering a controller to shut off the motor 30.

Due to the speed and oscillation of the needle 138, it can be difficult to detect when the needle 138 has contacted the contact 150. Therefore, in some embodiments, the drain clearing air gun 10 includes a noise filtration feature to ensure proper shut off of the motor 30 rather than unintentional or accidental shut offs. The controller detects when the needle 138 has contacted the electrical contact 150 a predetermined number of times. When the predetermined number of contacts is reached, the controller identifies that the preset pressure has been reached and shuts off the motor 30 to stop the air pump 42 from pumping air into the chamber 90. For example, in one embodiment, the controller monitors the number of times the needle 138 has contacted the electrical contact 150 through an accumulator, which samples a pressure switch input single at a rate of 1 ms. The accumulator counts whether the noisy signal is high or low. When the noisy signal is high, the needle 138 is truly in contact with the electrical contact 150, and the controller shuts off the motor 30. When the noisy signal is low, the needle 138 is not truly in contact with the electrical contact 150 (i.e., the contact is considered noise), and the controller does not shut off the motor 30.

In addition to the single needle shut off design, the pressure gauge 62 also includes one or more safety shutoff features. Specifically, the controller is configured to shut off the motor 30 if the motor 30 has been running for more than a predetermined time period. Similarly, the controller of the drain clearing air gun 10 includes a protection mechanism in case the first actuator 68*a* for starting the motor 30 accidently gets stuck or is jammed in the engaged position. The controller of the drain clearing air gun 10 uses a timer to tell how long the actuator 68*a* has been pressed. If this timer senses an actuator signal equal to or longer than the maximum run time, the controller will shut down the drain clearing air gun 10, until the actuator 68*a* is released/open.

Additionally, the controller is configured to monitor current draw of the motor 30 and shut off the motor 30 if the current draw rises above a predetermined current level (e.g., potentially preventing the pressure from getting too high). Also, the drain clearing air gun 10 includes a mechanical pressure relief valve that screws into the back of the tank 50. When the pressure exceeds a predetermined pressure level, the relief valve will vent the tank 50, inhibiting overpressure. These systems ensure proper functionality of the drain clearing air gun 10.

Drop Protection

With continued reference to FIGS. 8-10, the illustrated pressure gauge 62 is provided with drop protection. The pressure gauge 62 includes a housing 14 that supports the internal working components of the pressure gauge 62. When the drain clearing air gun 10 is dropped or receives an impact, the drop/impact can damage the working components of the pressure gauge 62 and occasionally cause the pressure gauge 62 to provide inaccurate readings. For example, the bladder may become deformed or dented, which leads to the pressure gauge 62 not being properly calibrated. For example, the pressure gauge 62 may read 30 psi when the tank 50 actually has no pressure. To help inhibit the internal parts of the pressure gauge 62 from being damaged, a dampener 154, as shown in FIG. 10, is inserted into the outer housing 14 of the pressure gauge 62. The dampener 154 extends around an inside wall of the housing 14. The dampener 154 creates a buffer between the inside wall of the housing 14 and the bladder or other internal components. In some embodiments, the dampener 154 is a ring that extends about the entire circumference of the inner wall. In other embodiments, the dampener 154 may only extend along a portion of the inner wall. The dampener 154 can be made of any vibration absorbing material. For example, in some embodiments, the dampener 154 is a 1.5 mm piece of foam. In other embodiments, the dampener 154 may be rubber or plastic. This pressure gauge arrangement, including the dampener 154, may also be used in pressure gauges of other types of tools.

Quick Disconnect

Drains of various sizes, configurations, etc., may be cleared using the drain clearing air gun 10. In order to interface with these various drains, different accessories 68 (FIG. 11) are provided to be attached to the drain clearing air gun 10 (e.g., to access different drains, seal different drains, etc.). The illustrated drain clearing gun 10 includes the quick connection mechanism 66 so different accessories 68 are easily exchanged.

Figure 11:
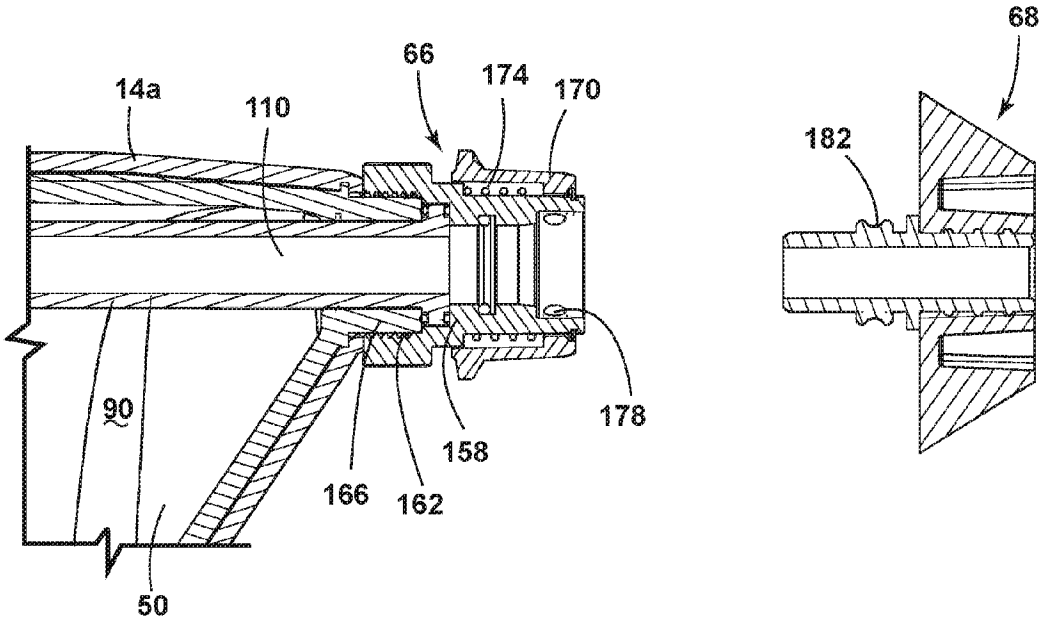
FIG. 11 is an enlarged cross-sectional view of the connection mechanism shown in FIG. 6.

FIG. 11 illustrates one embodiment of the quick connection mechanism 66. The illustrated connection mechanism 66 includes a hollow receiving member 158. The receiving member 158 is generally cylindrical and includes a hollow interior for receiving the accessory 68. The receiving member 158 includes threads 162, which are configured to engage with threads 166 on the tank 50. A sleeve 170 concentrically surrounds the receiving member 158 and is configured to slide axially relative to the receiving member 158. The sleeve 170 is moveable between a locked position and a released position. The sleeve 170 is biased towards the locked position by a biasing member 174 (e.g., a coil spring).

In the locked position, the sleeve 170 engages with at least one detent member 178 and biases the detent member 178 radially inward. In the illustrated embodiment, the detent member 178 is a ball. When biased radially inward, the detent member 178 extends into the hollow interior of the receiving member 158 where the detent member 178 can engage with an accessory 68 and maintain the accessory 68 within the receiving member 158. Specifically, the detent member 178 engages with a recess 182 in the accessory 68 to maintain the accessory 68 within the hollow interior of the receiving member 158.

To release the accessory 68, the sleeve 170 is slid axially against the biasing force of the biasing member 174. When the sleeve 170 is slid axially into the released position, the sleeve 170 no longer biases the detent member 178 radially inward into engagement with the recess 182 of the accessory 68. Accordingly, the accessory 68 can be removed from the hollow interior of the receiving member 158.

Plunger Accessories

Figure 13:
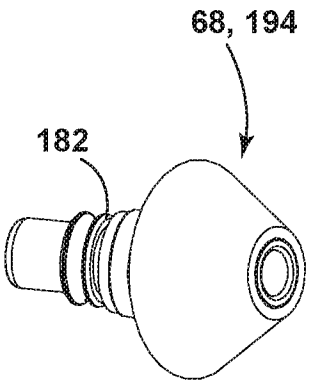
FIG. 13 illustrates another accessory for use with the drain clearing air gun of FIG. 1.
Figure 12:
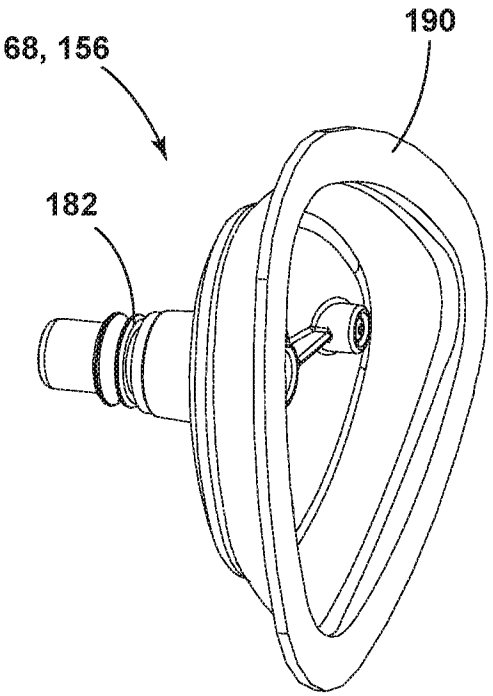
FIG. 12 illustrates an accessory for use with the drain clearing air gun of FIG. 1.
Figure 14:
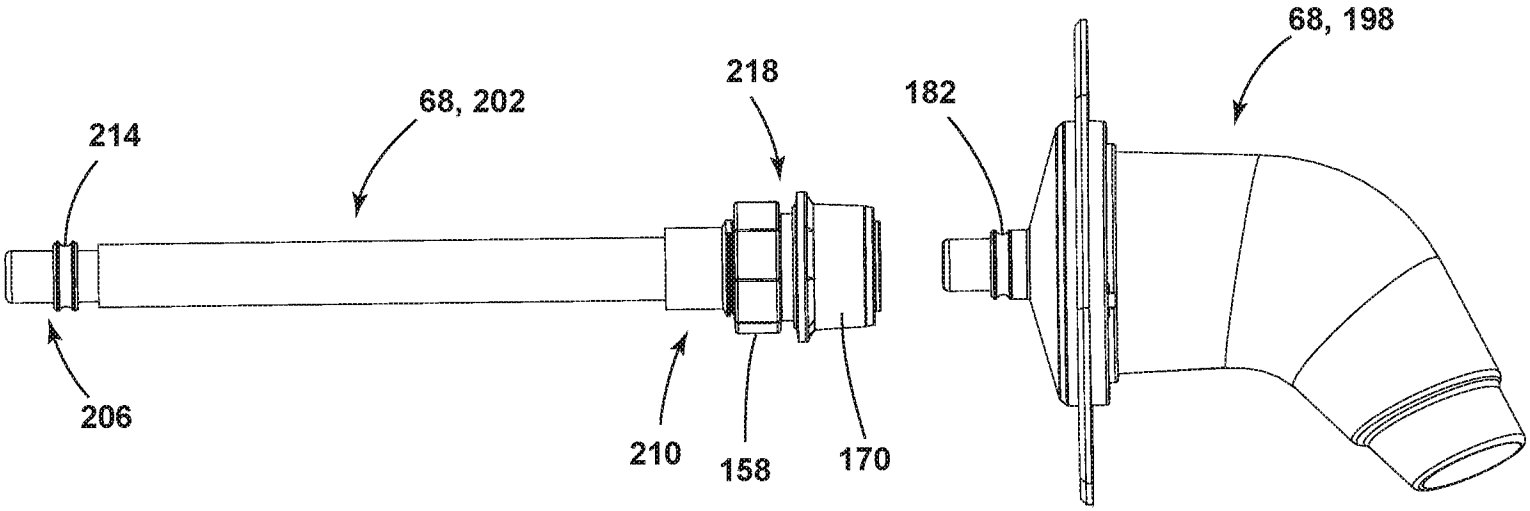
FIG. 14 illustrates another accessory for use with the drain clearing air gun of FIG. 1.

FIGS. 12-14 illustrate various plunger accessories 68 for use with the drain clearing air gun 10. FIG. 12 illustrates a donut accessory 186 that can cover a drain and seal the drain before operating the drain clearing air gun 10. The donut accessory 186 has a pliable (e.g., rubberized) ring 190 that allows the donut accessory 186 to mold and seal drains with an odd geometry.

FIG. 13 illustrates a plug accessory 194 with a conical shape that can be inserted partially into the drain to seal the drain.

FIG. 14 illustrates an elbow accessory 198, which can be used to access drains that are in difficult to reach or tight spaces. The elbow accessory 198 has a curved shape with a narrower insertion end and a wider attachment end. The illustrated elbow accessory 198 is shown with an extender accessory 202, which can be attached between the tank 50 and any of the other plunger accessories 68 to provide extra length to the drain clearing air gun 10 to reach a drain. The extender accessory 202 includes a first end 206 for attaching to the connector mechanism on the main body 18 of the drain clearing air gun 10, and a second end 210 for attaching to another drain clearing air gun accessory 68. The first end 206 of the extender accessory 202 includes a recess 214 for engaging with the detent member 178 of the connection mechanism 66. The second end 210 includes a second connection mechanism 218 that is the same or similar to the connection mechanism 66 discussed above. The second connection mechanism 218 can connect to different plunger accessories 68 in the same way as the first connection mechanism 66.

Electronics Options

The illustrated drain clearing air gun 10 includes a push button start/signal level switch which is monitored by a microcontroller. The microcontroller is also used to control a timed motor shutoff to inhibit over pressure from occurring in case of an automatic shutoff mechanism failure. In addition, the illustrated drain clearing air gun 10 includes a work light, such as an LED, which automatically activates when the motor 30 is running or can be activated independently of motor operation. In addition, the main switching semiconductor (MOSFET) electronics design is integrated with a redundant switching semiconductor (MOSFET). The main switching semiconductor design and the redundant switching semiconductor are arranged in series as a redundant shut-off system. A microcontroller algorithm is used for over current limiting. The microcontroller shuts the drain clearing air gun 10 off when the current passing through the motor 30 is above certain threshold. The drain clearing air gun 10 can include a "last puff feature," which is used to prevent the drain clearing air gun 10 from starting a compression cycle it cannot finish in case battery charge status is below certain threshold.

Operation of the Drain Clearing Air Gun

In operation, a user can choose the desired accessory 68 that is appropriate for the drain being unclogged. The accessories 68 can be interchangeably coupled to the drain clearing air gun 10 by moving the sleeve 170 of the quick connection mechanism 66 axially to the released position and removing an accessory 68 that is currently connected to the gun 10. The desired accessory 68 can then be attached by maintaining or again sliding the sleeve 170 axially to the released position and then inserting the desired accessory 68 into the nose 26 of the drain clearing air gun 10. When the sleeve 170 is released, the sleeve 170 will automatically be biased back to the locked position by the biasing member 174.

The user can then set the desired maximum pressure for the drain clearing air gun 10 by rotating the bezel 142 of the pressure gauge 62 until the indicator 146 is aligned with the desired maximum pressure on the faceplate 130 of the pressure gauge 62. The electrical contact 150 will rotate with the bezel 142 and maintain alignment with the indicator 146. Then, the user can actuate the first actuator **58*a* to energize the motor 30 and start the pressure build up stage. During the pressure build up stage, the motor 30 will drive the pump 42 to pump pressurized air into the tank 50 until the tank 50 reaches the desired maximum pressure. Specifically, the pressure gauge 62 will continuously measure the pressure in the tank 50. As the pressure increases, the needle 138 of the pressure gauge 62 rotates relative to the faceplate 130. When the needle 138 reaches the desired pressure (marked by the indicator 146), the needle 138 will come into contact with electrical contact 150, which is aligned with the indicator 146. Engagement between the needle 138 and the electrical contact 150 completes a circuit, triggering a controller to shut off the motor 30 and discontinue pumping air into the tank 50**.

The drain clearing air gun 10 is now prepared to send pressurized air into a drain to break up a clog. The user will aim the drain clearing air gun 10 into the drain and actuate the second actuator **58*b* to release the pressurized air from the tank 50. When the second actuator 58*b* is triggered, the pilot valve 46** opens, allowing air to flow from the chamber 90 of the tank 50 into the conduit 110 and through the nose 26 of the drain clearing air gun 10.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A drain clearing air gun comprising:

a housing defining a main body, a handle positioned on a first end of the main body, and a nose positioned on a second end of the main body;

a tank at least partially positioned within the housing and including a chamber for receiving pressurized air, the tank including an outer wall defining a boundary of the tank, the boundary having a maximum length and a maximum height, the tank also including a recess formed within the tank such that a section of the outer wall that defines the recess is positioned within the maximum length and the maximum height of the boundary;

a motor positioned within the main body of the housing, at least a portion of the motor being received within the recess of the tank such that the motor overlaps with the boundary of the tank; and a pump positioned within the main body of the housing and operatively coupled to the motor, the pump being driven by the motor to pump air into the tank.

2. The drain clearing air gun of claim 1, wherein the tank includes a nose end directed towards the nose of the housing and a rear end directed towards the handle of the housing, and wherein the recess is disposed within the rear end of the tank.

3. The drain clearing air gun of claim 2, wherein the nose end of the tank is disposed within the nose of the housing, and wherein the rear end of the tank is disposed within the main body of the housing.

4. The drain clearing air gun of claim 2, further comprising a pilot valve disposed within the tank, wherein the pilot valve is operable to selectively release pressurized air from the chamber of the tank.

5. The drain clearing air gun of claim 4, wherein the tank includes a compartment formed at the rear end of the tank, and wherein the pilot valve is supported by the compartment.

6. The drain clearing air gun of claim 1, further comprising a pressure gauge supported by the housing and fluidly coupled to the tank, wherein the pressure gauge is configured to measure a pressure in the tank.

7. The drain clearing air gun of claim 6, wherein the pressure gauge is electrically coupled to the motor and includes:

a faceplate with tick marks representing various pressures, a needle movably coupled to the faceplate for indicating the current pressure measured by the pressure gauge, the needle being composed of an electrically conductive material, a bezel rotatably coupled to the faceplate for movement relative to the faceplate, and an electrical contact coupled to the bezel for movement with the bezel relative to the faceplate, wherein when the needle contacts the electrical contact, the motor is shut off.

8. The drain clearing air gun of claim 1, wherein the tank includes a first portion and a second portion that are coupled together to form the chamber, wherein the first portion is disposed within the nose of the housing and formed of a first material, and wherein the second portion is disposed within the main body of the housing and formed of a second material that is different than the first material.

9. The drain clearing air gun of claim 8, wherein the first material is a plastic, and wherein the second material is a metal.

10. A drain clearing air gun comprising:

a housing defining a main body, a handle positioned on a first end of the main body, and a nose positioned on a second end of the main body; and a tank at least partially positioned within the housing and including a chamber for receiving pressurized air, the tank having a first portion and a second portion that are coupled together to form the chamber, the first portion being disposed within the nose of the housing and formed of a first material, the second portion being disposed within the main body of the housing and formed of a second material that is different than the first material.

11. The drain clearing air gun of claim 10, wherein the first portion of the tank is threadably coupled to the second portion of the tank.

12. The drain clearing air gun of claim 10, wherein the first material is a lighter-weight material than the second material.

13. The drain clearing air gun of claim 10, wherein the first material is a more corrosion-resistant material than the second material.

14. The drain clearing air gun of claim 10, wherein the first material is a plastic, and wherein the second material is a metal.

15. The drain clearing air gun of claim 10, further comprising a pressure gauge supported by the housing, wherein the second portion of the tank includes a plurality of openings for fluidly connecting the tank to a pump and to the pressure gauge.

16. The drain clearing air gun of claim 10, further comprising a pilot valve positioned within the tank, wherein the pilot valve is operable to selectively release pressurized air from the chamber of the tank, and wherein the second portion of the tank includes a compartment for supporting the pilot valve.

17. The drain clearing air gun of claim 10, further comprising a rubber boot surrounding the first portion of the tank.

18. A drain clearing air gun comprising:

a housing defining a main body, a handle positioned on a first end of the main body, and a nose positioned on a second end of the main body;

a tank at least partially positioned within the housing and including a chamber for receiving pressurized air, the tank having a nose end with an opening disposed within the nose of the housing and a rear end disposed within the main body of the housing;

a pilot valve disposed within the tank proximate the rear end of the tank, the pilot valve operable to selectively release pressurized air from the chamber of the tank; and a conduit disposed within the tank, the conduit extending from the pilot valve to the opening of the tank to direct pressurized air out of the tank through the opening.

19. The drain clearing air gun of claim 18, further comprising a motor positioned within the main body of the housing, and an actuator supported by the handle, the actuator electrically coupled to the motor and operable to selectively energize the motor.

20. The drain clearing air gun of claim 19, wherein the actuator is a first actuator, and further comprising a second actuator supported by the handle, wherein the second actuator is coupled to the pilot valve to selectively open the pilot valve.

21. The drain clearing air gun of claim 18, wherein the pilot valve includes a plunger and a spring, wherein the plunger has a sealing member that selectively engages an inlet of the conduit, and wherein the spring biases the plunger toward the conduit.

22. The drain clearing air gun of claim 18, wherein the tank includes a first portion defining the nose end and a second portion defining the rear end, wherein the first portion is formed a first material configured to be submerged in water, wherein the second portion is formed of a second material that is different than the first material, and wherein the pilot valve is positioned within the second portion of the tank.

* * * * *